US005139434A

United States Patent [19]

Goodman

[11] Patent Number: 5,139,434

[45] Date of Patent: Aug. 18, 1992

[54] STRAIN RELIEF FOR INSULATION DISPLACEMENT CONTACT

[75] Inventor: Joseph R. Goodman, Tokyo, Japan

[73] Assignee: AMP Incorporated, Harrisburg, Pa.

[21] Appl. No.: 797,516

[22] Filed: Nov. 22, 1991

[30] Foreign Application Priority Data

Dec. 10, 1990 [JP] Japan ..... 2-402091

[51] Int. Cl.[5] ..... H01R 4/24

[52] U.S. Cl. ..... 439/399

[58] Field of Search ..... 439/389–425

[56] References Cited

U.S. PATENT DOCUMENTS 4,040,702 8/1977 McKee et al. ..... 439/399

4,264,118 4/1981 Nijman ..... 439/407

4,385,794 5/1983 Lucius ..... 439/399

*Primary Examiner*—Joseph H. McGlynn

*Attorney, Agent, or Firm*—Adrian J. LaRue

[57] ABSTRACT

An electrical contact (50) includes a forward spring contact portion (51) and an integral insulation displacement portion (60) having slots (S) formed in blades (61, 62) which terminate an insulated wire (17) and, axially spaced therefrom, a wire strain relief portion (64) which includes a resilient support having legs (63, 65) supporting the wire as embraced by crimped arms (66, 68) to hold the wire axially in a straight line relative to the slots (S) to provide a controlled height of the wire in the insulation displacement portion (60) of the contact.

10 Claims, 2 Drawing Sheets

STRAIN RELIEF FOR INSULATION DISPLACEMENT CONTACT

This invention relates to an electrical contact or terminal of the insulation displacement type wherein a wire strain relief is provided to protect the connection formed by such contact.

BACKGROUND OF THE INVENTION

Insulation displacement contacts are widely used for interconnecting electrical wire, particularly fine wires utilized for transmitting signals in computers, business machines, and the like. A wide variety of such contacts have evolved to include features like the prior art contact 10 shown in FIGS. 4 and 5. There, contact 10 is formed of flat conductive sheet material to include a pair of upstanding blades 12 and 14 having centrally disposed slots S. Leading to the slots S are tapers T and at the bottom of each slot is a bight B. The blades 12 and 14 extend upwardly, essentially at right angles to a base 16, which is shown in FIGS. 4 and 5 to be limited to the plates 12 and 14; it being understood that typically the base 16 may extend fore and aft of such blades to be joined to a wire strain relief in a manner to be described and to a further part of the contact used for interconnection purposes.

With respect to the blades 12 and 14, the tapers T serve to position and guide the insertion of a wire 17 having a conductive core 18 of solid or stranded wire surrounded by an insulating sheath 20. The slots S are given a width less than the diameter of the conductive core 18, and the thickness of the blades 12 and 14, in conjunction with the edges of the slots, serve to cut and therefore strip the insulation sheath 20 sufficiently for the edges of the slots S to deform the wire and form a low resistance, stable electrical interface or connection with the core 18. As can be seen in FIG. 5, the conductive core 18 is positioned within the slot S at a point removed from the bight B. Care must be taken with respect to the contact shown in FIG. 4 and to similar contacts that the core is not pushed downwardly upon loading the wire in the contact to a point wherein the bight B cuts into the wire and severs either strands or the wire core itself.

In FIG. 6, a further prior art representation is shown of an electrical contact 30 which includes a base 31, analogous to the base 16 heretofore referred to and extending forwardly a spring contact 32 which would engage a further contact, not shown, such as a pin or post in a connector. As can be seen, an insulation displacement portion 34 includes a pair of blades 33 and 35 which have the characteristics heretofore described with respect to FIGS. 4 and 5. The wire 17 can be seen to be inserted in insulation displacement portion 34. To protect the connection made in the insulation displacement portion 34, a strain relief 36 is provided from material struck out of the base material from which 31 is formed and folded, or crimped, down on the wire as shown in 36. As can be seen, the wire 17 is pushed down against the base 31, forming a bend 38 in the wire. This has been found to create stresses in the wire which can interfere with the interconnection between the wire core 18 and the slots in the insulation displacement blades. Furthermore, the fact that there is a bend, a difference of height relating to the different parts of the wire, can result in a sensitivity making it more difficult to avoid pushing the wire core into engagement with the bight, as discussed in the contact presented in FIGS. 4 and 5.

Accordingly, it is an object of the present invention to provide an insulation displacement type contact having an improved wire strain relief incorporated in the contact in relation to insulation displacement slotted blades. It is a further object to provide a contact having an insulation displacement portion in conjunction with a wire strain relief which is adjustable from design to design to fix the height of the wire relative to the base of the contact. It is yet a further object to provide a wire strain relief which is resilient and which positions a wire in essentially a straight line relative to a contact base to preclude strains and stresses to the interconnection made in insulation displacement contact.

SUMMARY OF THE INVENTION

The present invention achieves the foregoing objectives through the provision of an electrical contact having an insulation displacement portion, including slotted blades adapted to strip the insulation of the wire and form an interconnection with the core thereof in conjunction with a novel strain relief which holds the wire essentially along a straight line, axially parallel to the base of a contact. The invention contact features a strain relief portion spaced from the insulation displacement portion of a contact and including arms which are crimped downwardly to embrace the insulation of a wire placed in such contact, against legs forming a wire support beneath the arms of the strain relief portion. The contact is formed of thin conductive sheet material, suitably stamped and formed with the arms and legs of the strain relief portion struck out from the material at the edges of the base of the contact. The arms of the strain relief are formed to be U-shaped to receive the wire with the legs of the strain relief formed over so that upon the arms being crimped inwardly and downwardly to embrace the wire, the legs receive the wire engaging the insulation thereof. The legs of the strain relief portion are positioned above the base of the contact so as to hold the wire in essentially a straight line, passing through the slots of the blades of the contact, well above the bight of the slots and essentially parallel to the base of the contact. The strain relief portion of the contact includes arms spaced apart as well as legs supporting the wire spaced apart thereby forming a segment for gripping the wire to further reduce the possibility of wire movement which can affect the interconnection with the insulation displacement portion of the contact.

IN THE DRAWINGS

DETAILED DESCRIPTION OF THE INVENTION

Figure 1:
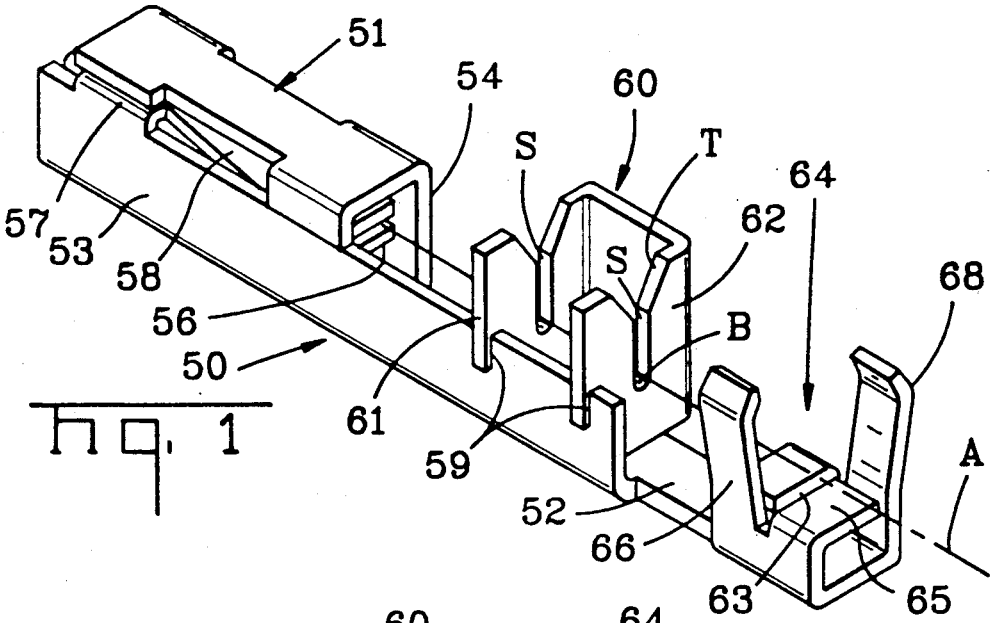
FIG. 1 is a perspective view showing the contact of the invention, substantially enlarged from actual size, without a wire positioned therein and prior to crimping of the strain relief.

Referring now to FIG. 1, a contact 50 is shown, incorporating the features of the invention. The contact 50 is formed of conductive sheet metal such as brass or phosphor bronze, or other materials having appropriate hardness and spring characteristics. Contact 50 is preferably stamped and formed in progressive dies to include the features shown. A front portion 51 of the contact is adapted to interconnect with further contacts, including particularly in the illustrative embodiment, a post, not shown, which fits inside portion 51. The portion 51 is connected to the rest of the contact by a base 52, and there is a side wall 53 which extends along a substantial portion of the contact length. In the version shown in FIG. 1, a box 54 is provided with a projection of the side wall 53 forming a contact spring 58.

Figure 4:
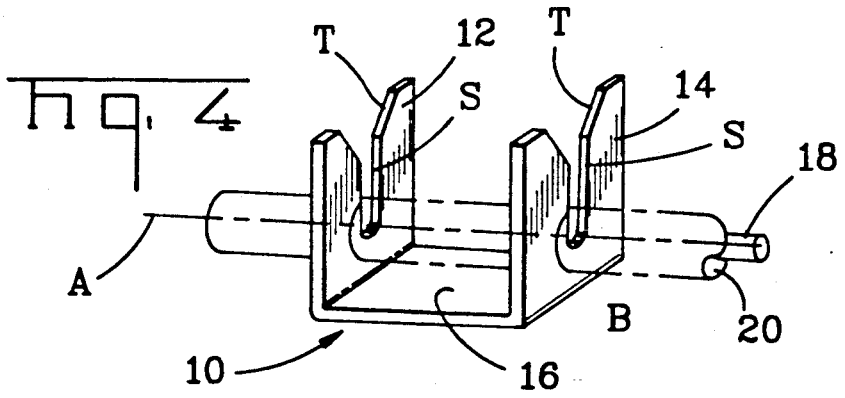
FIG. 4 is a perspective view, considerably enlarged from actual size, showing the insulation displacement contact in accordance with the prior art to illustrate the background of the invention.
Figure 5:
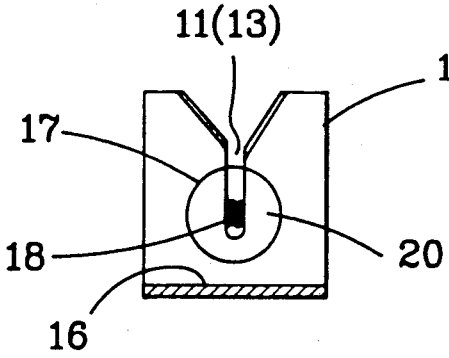
FIG. 5 is an elevational view, in section, of a portion of the contact shown in FIG. 4.

The side wall 53 is notched as at 59 and an insulation displacement portion 60 is provided with plates 61 and 62 folded over the base 52 with edges extending into the slots 59 in the manner shown in FIG. 1. As can be discerned from FIG. 1, the blades 61 and 62 are analogous to the blades 12 or 14 heretofore discussed with respect to FIGS. 4 and 5 and include slots S, tapers T, with bights B at the bottom end of the slots positioned above the base 52. The strain relief portion 64 of the contact includes two support legs 63 and 65 and two arms 66 and 68. As can be discerned from FIG. 2, the arms 66 and 68 are spaced apart as are the legs 63 and 65 so as to effectively grip a segment of the wire and not just a point of the wire. As can be seen in FIG. 1, the contact 50 has the arms 66 and 68 extending upwardly, the ends being slightly turned to facilitate crimping in standard crimping dies of a standard crimping tool, and the arms are spaced apart to readily receive the outer insulation sheath 20 of the wire 17. As also can be appreciated, the arms 66 and 68 are in alignment with the insulation displacement portion 60, an axis A extending through the slots S above and parallel to the base 52 in the manner shown in FIGS. 1 and 2.

Figure 2:
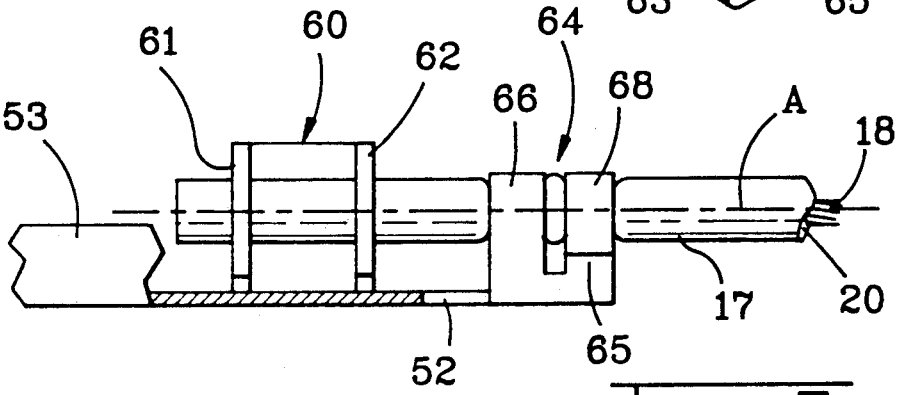
FIG. 2 is a side, partly sectioned view of the contact shown in FIG. 1 following the insertion of a wire therein and the crimping of the strain relief thereof.

In practice, a wire 17 is laid down on the contact 50 with the end positioned as indicated in FIG. 2, extending just past the blade 61, the wire centered in the tapers T and extending back over the arms 66 and 68. Thereafter, the dies of a tool (not shown) thrust the wire 17 downwardly in a direction transverse to the axis A with the wire being terminated by the insulation displacement portion 60. At the same time, or subsequently, tooling comes downwardly inelastically deforming the arms 66 and 68 with the wire embraced thereby and caused to bear against the legs 63 and 65. As can be discerned from FIGS. 1 and 2, the legs 63 and 65 are positioned in a spaced apart relationship axially and also above the base 52. As can be appreciated, the cantilever relationship of the legs 63 and 65 gives them a resilience and spring action to be slightly displaced upon the insulation sheath 20 being driven thereagainst through deformation of the arms 66 and 68. This resiliency readily accommodates for differences in wire size, particularly the insulating sheath 20. It is to be understood that the set height of the legs 63 and 65 can be adjusted to accommodate a wide range of wire insulating sheath diameters, for a given part number of a contact 50. To be observed in FIG. 2 is the fact that the wire 17, having been inserted in the contact 50 resides in essentially a straight line along axis A, which is parallel to and above the base 52. An adjustment of the tooling which stuffs the wire in the slots S maintains the front end of the wire at this height, and the legs 63 and 65 maintain the wire also at this height toward the rear of the terminal. To be observed also in FIG. 2 is the fact that the bights B are well below the position of the core 18 of the wire.

Figure 6:
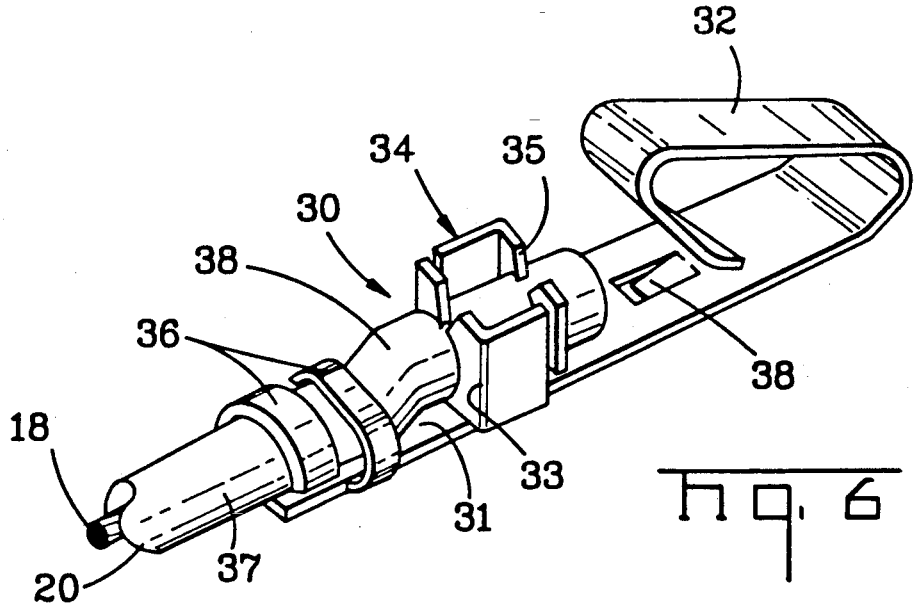
FIG. 6 is a perspective view showing a contact in accordance with the prior art, with the wire loaded and terminated thereto.

Also to be appreciated is the fact that the wire 17 is not at an angle as it would be in the prior art device shown in FIG. 6. To be also appreciated is that stresses and strains on the wire 17 or on the contact 50 caused by handling or in use, due to vibration and shocks as in vehicles or the like, will not be so readily transmitted to the termination area in the insulation displacement portion 60. This is due to the fact that the wire is gripped by the strain relief portion 64 well apart from the insulation displacement portion 60 and there is a redundancy of gripping through the spaced-apart embrace of the arms 66 and 68.

Figure 3:
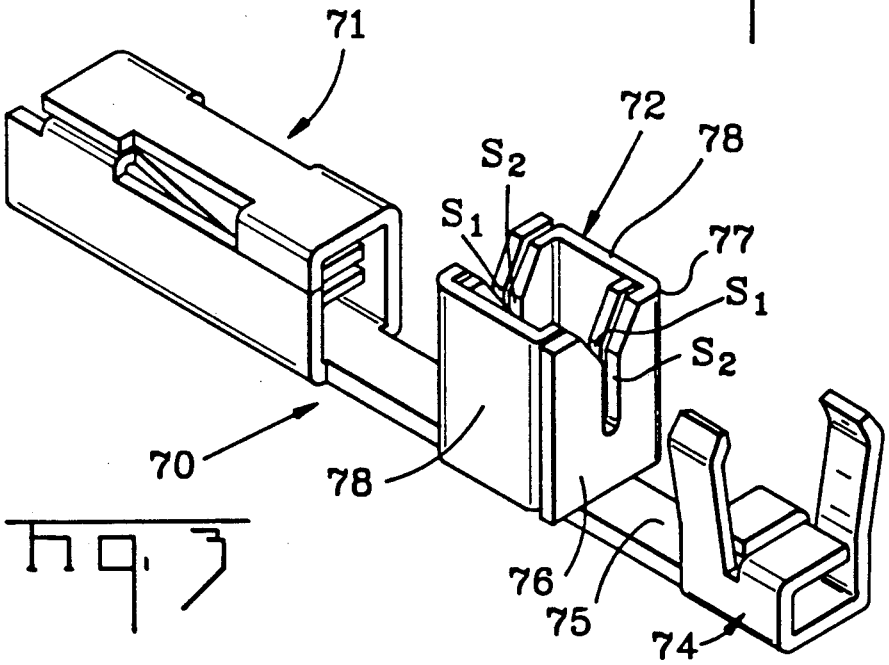
FIG. 3 is a perspective view of an alternative version of a contact.

FIG. 3 shows an alternative embodiment of a contact 70 which includes a forward portion 71 like 51 shown in FIG. 1, an insulation displacement portion 72 and a strain relief portion 74, all integrally formed relative to a base portion 75. The strain relief portion 74 is spaced from the insulation displacement portion 72 as with respect to the contact 50 and includes the same features of the support legs and deformable arms. As can be noted in FIG. 3, the insulation displacement portion 72 includes four plates, such as the plate 76, formed from the side walls such as 78. The plates include pairs of slots S1 and S2 and have the characteristics of the slots S heretofore described. Contacts like 70 are utilized for the more rigorous applications wherein vibration and shock are better accommodated by having four insulation displacement plates and slots. Nevertheless, it has been found useful to provide a segmental strain relief like that shown to make sure that stresses or strains of either the contact relative to the wire or the wire relative to the contact are minimized in the insulation displacement portion.

While the invention has been illustrated in contacts of a given type, it is contemplated that the invention may be used with other contacts having insulation displacement interconnection and particularly where stresses or strains to the wire contact can cause a working of the wire core within the slots to alter the resistance.

Having now described the invention in preferred embodiments intended to convey an understanding thereof, claims are appended, setting forth what is deemed to be inventive.

I claim:

1. An electrical contact (50) formed of conductive sheet material for terminating an electrical wire (17) having a conductive core (18) and an insulating sheath (20) including a base (52) extending along a given axis (A), an insulation displacement portion (60) having at least one plate (61, 62) formed from said base including a slot (S) formed to include a bight (B) and sides leading to an opening taper (T) to guide the wire into the slot to penetrate the insulation sheath and engage the conductive core in a low resistance, stable interface connection, a strain relief portion (64) proximate one end of said base including at least one arm (66, 68) positioned to be crimped to embrace the said wire through an engagement of the insulating sheath characterized in that the contact further includes at least one wire support leg (63, 65) extending from said base proximate said arm to hold said wire in an approximate straight line, parallel to said base and said axis (A) extending through the said slot to minimize strains on said wire core at said interface connection.

2. The contact (50) of claim 1 characterized in that the support leg (63, 65) extends from said base (52) and is folded to be spaced therefrom to provide a resilient support of said wire in a sense transverse to said axis.

3. The contact (50) of claim 1 characterized in that said strain relief portion (64) includes a pair of arms (66, 68) spaced apart in an axial sense relative to the wire length to provide a segment of said wire held in said strain relief portion.

4. The contact (50) of claim 1 characterized in that said support leg (63, 65) includes a cantilever spring structure to provide resilience to the said strain relief portion (64) and the said wire through the embrace of said arm.

5. The contact (50) of claim 1 characterized in that the said support leg (63, 65) is positioned above said base (52) to align said wire along said axis (A) above the bight (B) of the said slot.

6. The contact (50) of claim 1 characterized in that the said strain relief portion (64) is spaced axially apart from the said insulation displacement portion (60) to minimize stresses to the interconnection due to displacement of said wire.

7. The contact (50) of claim 1 characterized in that the contact portion (64) includes a plurality of blades spaced apart along said base to provide a redundant interface connection to said wire core and the said strain relief portion (64) is spaced apart axially along said base from said insulation displacement portion (64) and includes a pair of arms (66, 68) to provide a redundancy of strain relief.

8. The contact (50) of claim 1 characterized in that there being further provided a contact spring (51) at the end opposite to the said strain relief.

9. The contact (50) of claim 1 characterized in that the said contact strain relief portion (64) is formed with the arms (66, 68) and the said legs (63, 65) extending in cantilever fashion from the said base on either side thereof.

10. The contact (50) of claim 1 characterized in that the said strain relief portion includes a pair of arms (66, 68) spaced apart axially relative to the length of the said wire and there is provided a leg (63, 65) positioned in alignment with each said arm in a sense transverse to the axis (A) of the contact.

* * * * *